US006672123B2

(12) United States Patent
Sczesny et al.

(10) Patent No.: US 6,672,123 B2
(45) Date of Patent: Jan. 6, 2004

(54) SYSTEM FOR COLD-FORMING A FLANGE

(75) Inventors: Werner Sczesny, Bochum (DE); Frank Siewert, Dortmund (DE); Jürgen Bergmann, Dortmund (DE)

(73) Assignee: SMS Eumuco GmbH, Leverkusen (DE)

( * ) Notice: Subject to any disclaimer, the term of this patent is extended or adjusted under 35 U.S.C. 154(b) by 0 days.

(21) Appl. No.: 10/044,792

(22) Filed: Jan. 10, 2002

(65) Prior Publication Data

US 2002/0100305 A1 Aug. 1, 2002

(30) Foreign Application Priority Data

Jan. 11, 2001 (DE) ..... 101 00 868

(51) Int. Cl.[7] ..... B21D 3/02

(52) U.S. Cl. ..... 72/115; 72/117; 72/125; 72/420; 72/11.1

(58) Field of Search ..... 72/67, 70, 77, 72/83, 84, 85, 112, 115, 117, 124, 125, 370.01, 370.03, 370.1, 370.11, 418, 11.1, 17.3, 419, 420

(56) References Cited

U.S. PATENT DOCUMENTS

| | | | | | |
|---|---|---|---|---|---|
| 3,779,446 | A | * | 12/1973 | Lemelson | 72/112 |
| 3,798,944 | A | * | 3/1974 | Foster et al. | 72/67 |
| 4,173,876 | A | * | 11/1979 | Schaefer | 72/83 |
| 4,649,728 | A | * | 3/1987 | LaCount et al. | 72/85 |
| 5,622,071 | A | * | 4/1997 | Van Riper et al. | 72/117 |
| 5,946,959 | A | | 9/1999 | Anderheyden | |
| 5,956,987 | A | * | 9/1999 | Anthoine | 72/21.5 |
| 6,382,008 | B1 | * | 5/2002 | Jaubert | 72/21.4 |

* cited by examiner

*Primary Examiner*—Ed Tolan
(74) *Attorney, Agent, or Firm*—Herbert Dubno; Andrew Wilford

(57) ABSTRACT

A flange is formed on a workpiece by first mounting the workpiece in an inner holder shiftable along about a main axis and securing the inner holder against rotation about the main axis. A roller is rotated about the main axis adjacent the inner holder. Then the inner holder and workpiece are displaced axially to press the workpiece axially against the roller and deform the workpiece and form a flange thereon. This is done without heating the workpiece, that is in a cold-forming operation.

9 Claims, 12 Drawing Sheets

SYSTEM FOR COLD-FORMING A FLANGE

FIELD OF THE INVENTION

The present invention relates to a system for making an annular workpiece. More particularly this invention concerns a method of and apparatus for forming a flange.

BACKGROUND OF THE INVENTION

It is frequently necessary to form an integral flange on a tubular or solid workpiece. For instance a motor-vehicle drive shaft or rear end housing has flanges that allow attachment to a wheel or transmission housing. Such parts must be produced in large quantities to high tolerance, and in view of the application must also be made at the lowest possible unit cost.

As a result the piece is made by forming, normally in a complex multistage operation. The workpiece blank, for example a short length of a tube or rod, is cut off a longer workpiece and then while still warm is fed to the actual forming apparatus. The forming is done in several steps to produce a finished workpiece that in theory needs little or no machining.

Such a process is normal quite difficult and entails considerable handling of the workpiece. It is necessary to treat the workpiece before and after forming e.g. by phosphating after forming to prepare it for a subsequent heat treatment. Furthermore the several different forming steps often lead to misalignment at at least one stage, creating eccentric deformations that render the workpiece unusable.

In standard cold-forming systems the maximum angle of about 2° requires relatively high forces to work, and only certain shapes can be made. Furthermore the cycling time is relatively high and loading and unloading the machine, in particular when the workpiece is fairly long, is quite difficult.

Even the system of described in U.S. Pat. No. 5,945,959 which can use an angle up to 10° requires the workpiece to be heated, which further complicates use of the system and makes treatment time very critical. Such hot-forming requires the workpiece to be at a forging temperature, which means that it will need to be descaled after treatment. Even though less force can be used to achieve the desired deformation at high temperatures, the advantage is outweighed by the problems of heating and subsequently treating the workpiece. Furthermore when a thin-walled workpiece, e.g. a tube, is being treated it must be deformed rapidly before it cools and becomes too hard to work.

In some systems the end of the workpiece alone is heated electrically, thereby allowing the lower hot-forming pressure to be used. Nonetheless getting the temperature right and deforming while the workpiece maintains the right temperature is difficult, and the overall treatment time is normally quite long.

OBJECTS OF THE INVENTION

It is therefore an object of the present invention to provide an improved flanging system.

Another object is the provision of such an improved flanging system which overcomes the above-given disadvantages, that is which produces flanges, either on the end or middle of a workpiece or all alone as a sort of ring, in a simpler manner than the prior art.

More particularly this invention is a method and apparatus for forming a flange on a workpiece which does the entire formation in a single step with the workpiece at a single location.

SUMMARY OF THE INVENTION

A flange is formed on a workpiece by first mounting the workpiece in an inner holder shiftable along about a main axis and securing the inner holder against rotation about the main axis. A roller is rotated about the main axis adjacent the inner holder. Then the inner holder and workpiece are displaced axially to press the workpiece axially against the roller and deform the workpiece and form a flange thereon. This is done without heating the workpiece, that is in a cold-forming operation, so that the timing is not important and a very strong and smooth finished product is produced. A high-pressure water cutter can be used to produce the workpieces, so that the starting workpiece is not deformed and can be formed accurately.

It is possible with this system to operate within tolerances of about 0.1 mm. A subsequent machining operation can therefore be eliminated. Furthermore the use of an inner tool, which moves only axially and which can have an axially through-going passage to which the workpiece is fitted, means relatively long workpieces can be flanged relatively easily, since they are not rotated during the flanging operation so that getting them perfectly centered is not important and their mass is largely irrelevant. The cold-forming system of this invention can be used to make relatively thick flanges. Furthermore since it is the outer tool, not the workpiece, that is rotated, it is possible to operate at higher speeds with, therefore, less axial force and a more compact and easily controlled machine.

According to the invention the inner holder is formed around the workpiece with a recess and the workpiece is deformed into the recess. Furthermore a coolant and/or lubricant can be sprayed on the workpiece during deformation of the workpiece.

In accordance with the invention the workpiece is tubular and centered on the main axis. A mandrel is fitted snugly inside the workpiece during deformation of the workpiece. As the flange is formed the mandrel retracts axially against a spring force as the roller deforms the workpiece. In fact during the flanging operation the mandrel engages axially directly against the roller.

It is possible to internally engage the workpiece when it is tubular. Such internal engagement is easiest to do as the workpieces are cut off a longer blank and prevents rolling errors from being a problem. The workpiece can be engaged internally over about half of the wall thickness of the tubular workpiece.

The workpiece according to the invention has ends, one of which projects from the inner holder, and the flange is formed offset from the one end. In this case it is possible to roll down and reduce a wall thickness of the workpiece between the flange and the one end after forming the flange. It is also within the scope of this invention to deform the flange radially inward during deformation by the roller.

The roller according to the invention is rotated about an axis forming an angle of at least 10° with the main axis. In addition the roller is prevented from moving axially during the flange-forming operation.

The apparatus for forming a flange on a workpiece thus has according to the invention a frame, an inner holder shiftable on the frame along a main axis and adapted to hold the workpiece, and a roller rotatable about the main axis on the frame adjacent the inner holder. Actuators displace the inner holder and workpiece axially relative to the frame while the inner holder is secured against rotation. This presses the workpiece axially against the roller, deforms the workpiece, and forms a flange on the workpiece.

According to the invention a contactless measuring system connected to the inner holder produces an output usable by a control system to operate the actuators that advance the inner holder and workpiece. The actuators include a pair of double-acting cylinders flanking the main axis and connected between the inner holder and the frame. Such actuators therefore serve not only to advance the inner holder and workpiece against the rollers, but also to retract them therefrom after the flange is formed.

The flange-forming apparatus further has according to the invention a shaft journaled in the frame for rotation about the main axis, connected to the means, and carrying the roller. This shaft can be tubular to allow the inside of a tubular workpiece also to be given a shape by passing an appropriate tool through the tubular shaft. The roller is rotatable on the shaft about a roller axis forming an angle of at least 10° with the main axis. In addition a counterweight is provided on the shaft angularly equispaced about the main axis with the roller.

A traverse is axially displaceable on the frame and is fixed axially to a feed shaft displaceable into and out of contact with an inner end of the workpiece in the inner tool. Another actuator is braced between the traverse and the frame for axially displacing the feed shaft. This feed shaft is a tube shaft and a mandrel is slidable along the main axis in the tube shaft. A spring braced against the mandrel urges it axially outward toward the outer tool. During the flanging operation the mandrel actually contacts the roller to prevent the workpiece from collapsing inward.

An outer tool holder can carry a plurality of the rollers angularly equispaced about the main axis. In addition a plurality of secondary rollers carried on the outer tool holder can engage radially inward of the main axis with the flange is formed on the workpiece.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
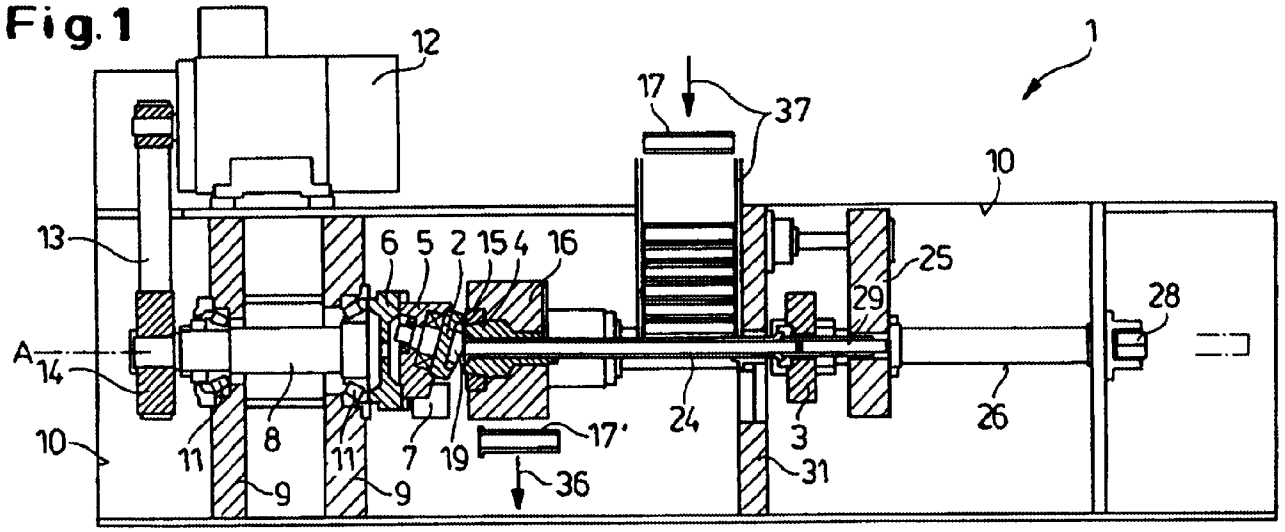
FIG. 1 is a small-scale side view of an apparatus for carrying out the method of this invention.
Figure 2:
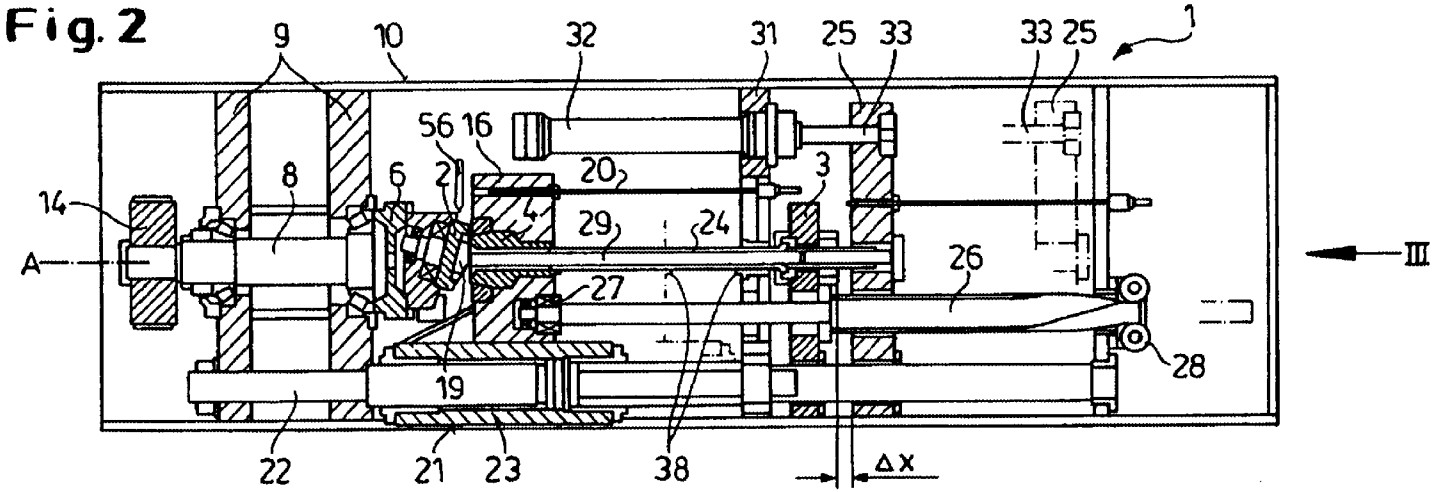
FIG. 2 is a top view of the apparatus of FIG. 1.
Figure 3:
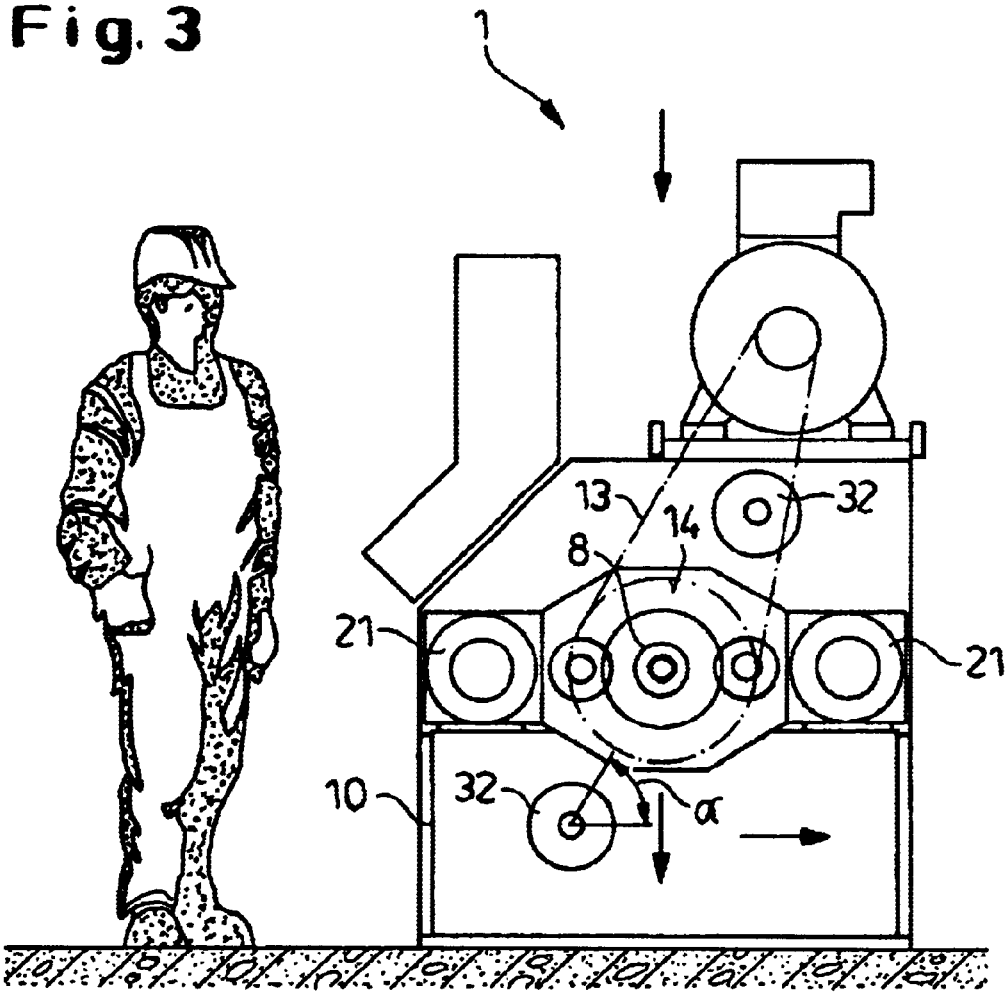
FIG. 3 is an end view taken in the direction of arrow III of FIG. 2.
Figure 4A:
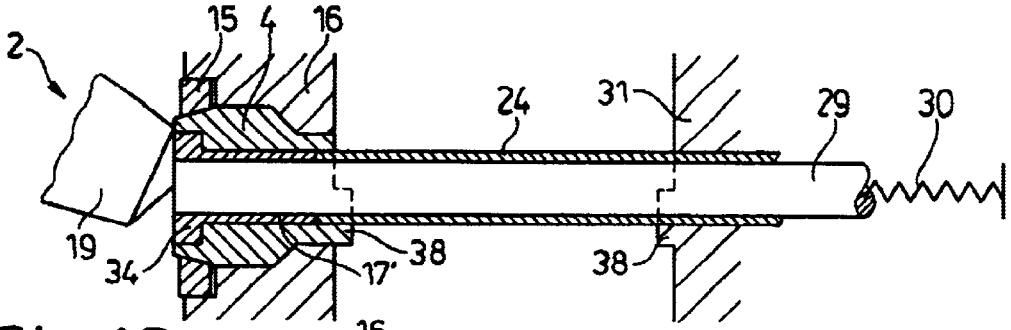
FIGS. 4A through 4E are detail sectional views illustrating the cold-forming method of this invention applied to a tubular workpiece.
Figure 4B:
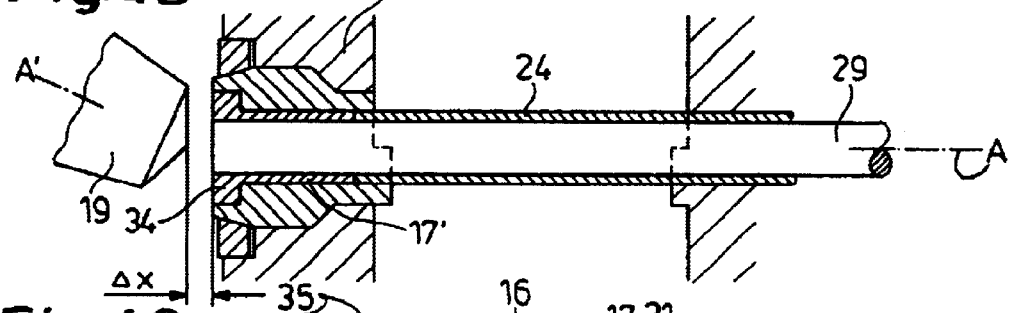
Figure 4C:
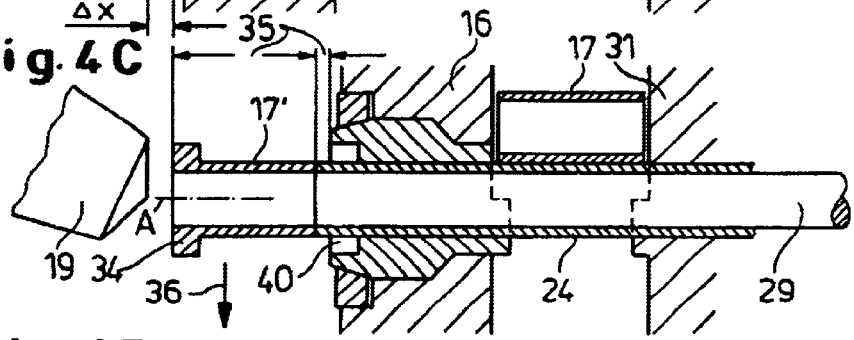
Figure 4D:
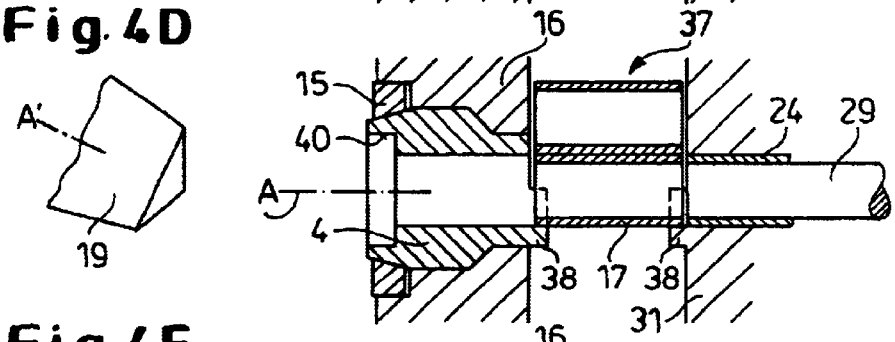
Figure 4E:
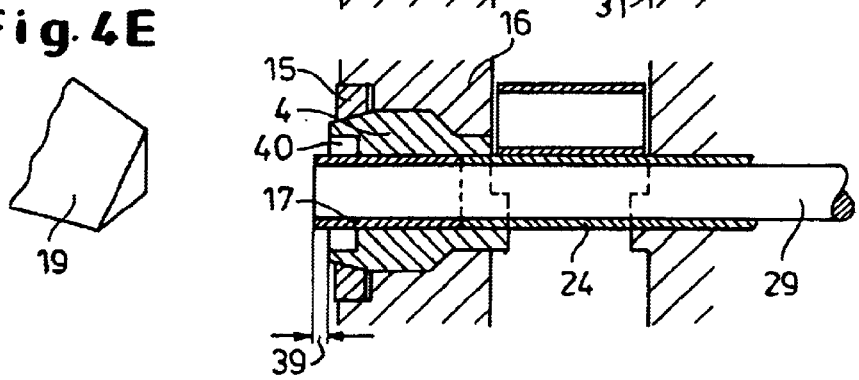

As seen in FIGS. 1 through 3 a flanging apparatus 1 according to the invention has a rotating outer tool 2 comprising a support or holder 5 carrying a roller-type tool head 19 and fixed on a support plate 6 rotatable about a roller axis A' (FIGS. 4B and 4D). A counterweight 7 is mounted on the holder 5 opposite the eccentrically mounted rotating tool 2. A nonrotating inner tool 4 is carried in a die-like holder or mount 16 that can move along a main axis A forming a small acute angle N (FIGS. 5A and 5B) with the axis A'.

The support parts 5 and 6 of the outer tool 2 are carried at an inner end of a tube shaft 8 extending along the axis A and supported by bearings 11 in cross beams 9 of a frame 10 of the machine 1. An alternating-current variable-speed motor 12 is connected via a toothed belt 13 to a sprocket or wheel 14 on the outer end of the shaft 8 to rotate the tool 2 about the axis A. Normally the motor 12 runs continuously and is only shut down when the workpiece format changes or the forming operation is stopped altogether, so as to save energy lost during frequent stops and starts. The plate 6 and/or the sprocket 14 can be provided with or constructed as a massive flywheel to reduce peak loads on the motor 12.

The nonrotating inner tool 4 is fixed by a clamp ring 15 in the holder 16. A no-contact measuring system 20 monitors the distance between the two tools 2 and 4 which is varied by a pair of double-acting cylinders 21 (see also FIG. 3) that diametrally flank the axis A and that each have a piston rod 22 fixed in the frame beams 9 and a cylinder 23 fixed to the mount 16.

Figure 8A:
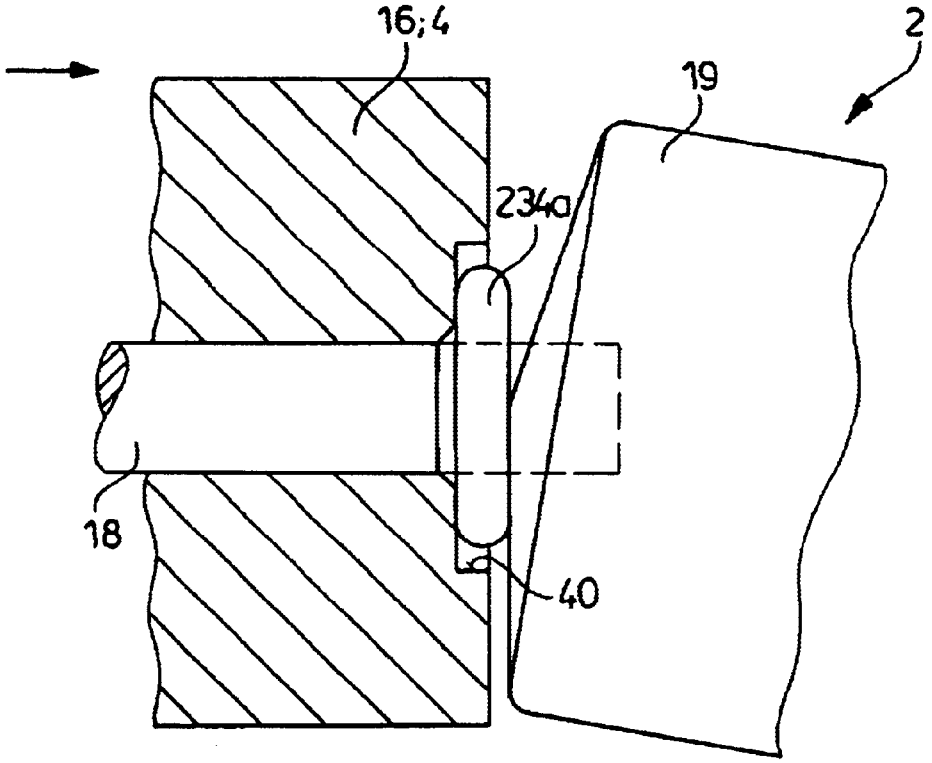
FIGS. 8A and 8B are views like FIGS. 5A and 5B but showing the formation of a middle flange on a solid workpiece.
Figure 8B:
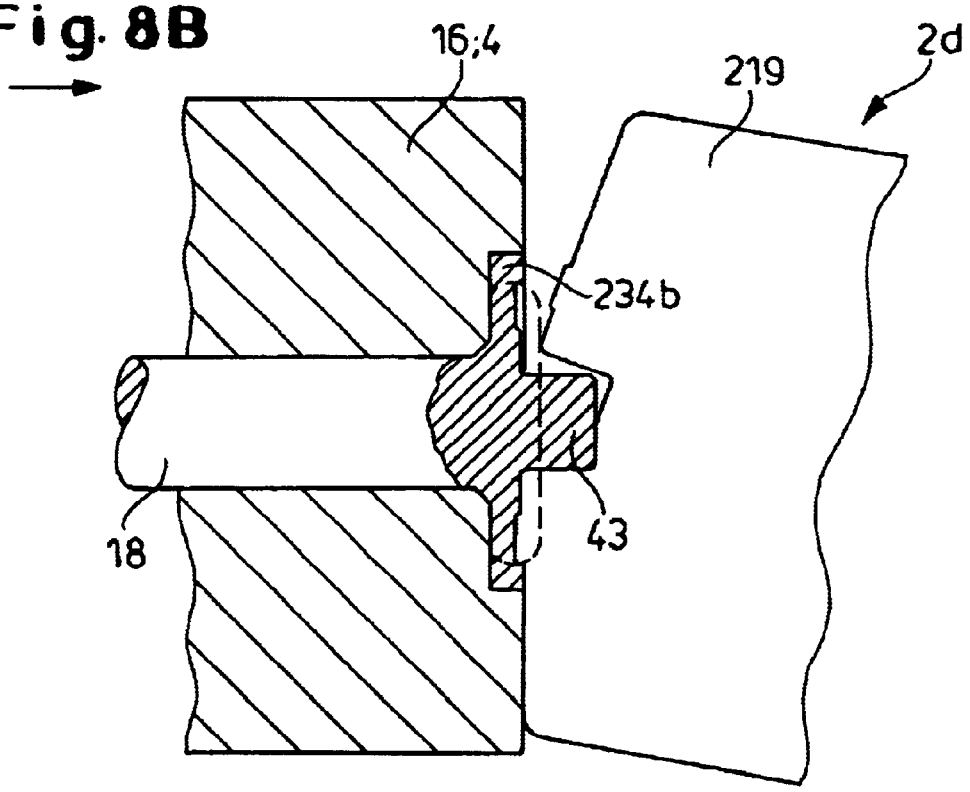

Tubular workpieces 17 as shown in FIGS. 4A–4E, 5A, 5B, 6A, 6B, and 7 or solid workpieces 18 shown in FIGS. 8A and 8B are fed axially to the inner end of the cylindrical axial passage through the holder 16 by a feed tube 24 and braced axially by this tube 24 during cold-forming as described below. The workpieces 17 or 18 can be cut the workpieces 17 cold from a longer tubular workpiece immediately before flanging them. The front end of this tube 24 can slide on the axis A in the annular holder 16 and its rear end is seated in a traverse 3 spaced outward from a slide 25 carried on piston rods 33 of cylinders 32 secured in a cross beam 31 of the frame 10. The cylinders 32 diametrally symmetrically flank the axis A and form therewith a plane forming an acute angle $\alpha$ (FIG. 3) with the horizontal.

A rod 26 has a front end seated in an axial thrust bearing 27 in the holder 16 and a flattened rear end that slides axially in a complementary flattened aperture in the slide 25 and that is engaged between a pair of fixed rollers 28 carried on the frame 10. Thus, when the cylinders 32 push back the slide 25, they first pull the feed tube 24 axially out of the back of the holder 16 and, once it is clear of the holder, the rollers 28 twist this shaft 26 and cause the traverse 3 to pivot about the rod 26 through 90°, out of alignment with the axis A so that a new workpiece 17 can be loaded in from a hopper 37. The inner periphery of its tubular end is beveled or chamfered to facilitate entry of a tool or other part into it.

The feed tube 24 surrounds a mandrel rod 29 that can fit snugly axially inside the tubular workpieces 17 to prevent them from being deformed inward during the cold-forming operation. The chamfered edge facilitates such engagement of the mandrel 29 into the workpieces 17. A spring 30 (FIG. 4A) urges the rod 29 outward (to the left in FIGS. 1 and 2). A sprayer 56 may direct a jet of liquid serving as coolant and/or lubricant on the workpiece 17 where it projects from the inner tool 4.

More particularly as shown in FIGS. 4A through 4E, a flange 34 is formed (FIG. 4A) on the tubular workpiece 17 as will be described below by the conically tipped head 19 of the tool 2, and then the holder 16 with the inner tool 4 is retracted (FIG. 4B) through a short distance Δx from the axially nondisplaceable tool 2 by means of the cylinders 21 while the tube 24 is also retracted through this distance Δx by the cylinders 32. Then (FIG. 4C) the cylinder 21 retracts the holder 4 axially inward through a substantially greater distance 35 while the tube 24 is held stationary to push the finished workpiece 17 out the outer end of the passage of the tool 4 and to leave the rear face of the tool 4 spaced from the front face of the cross beam 31 by a distance equal to slightly more than the length of one of the workpieces 17. This allows the finished workpiece 17' to drop off as shown by arrow 36.

Then the tube 24 and the mandrel 29 are retracted (FIG. 4D) back into the traverse 31 so that another workpiece 17 can drop down on U-shaped supports 38 formed on the back face of the tool 4 and the front face of the traverse 31. Thus the new workpiece 17 is axially perfectly aligned with the passage of the tool 4. The tube 24 and rod 29 are then (FIG. 4E) axially advanced to push the new workpiece 17 so it projects by a distance 39 past a front face of the tool 4 so that it can be deformed outward into an annular cavity 40 in which the flange 34 is formed.

Figure 5A:
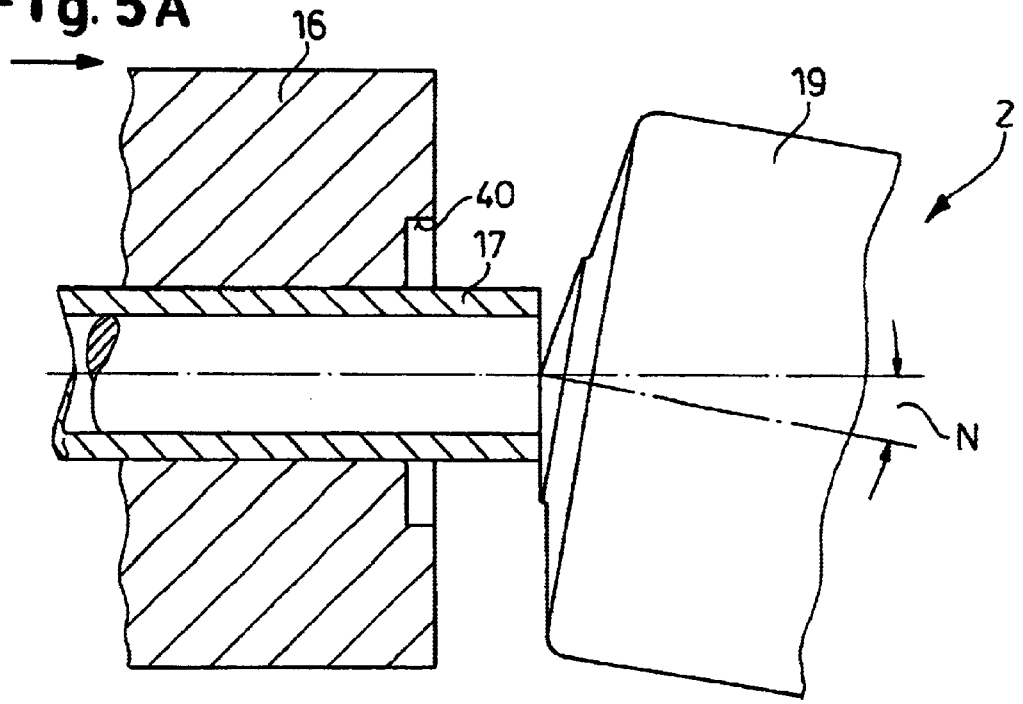
FIGS. 5A and 5B are side views illustrating successive steps in formation of an end flange on a tubular workpiece using tool slightly different from that of FIGS. 4A through 4E.
Figure 5B:
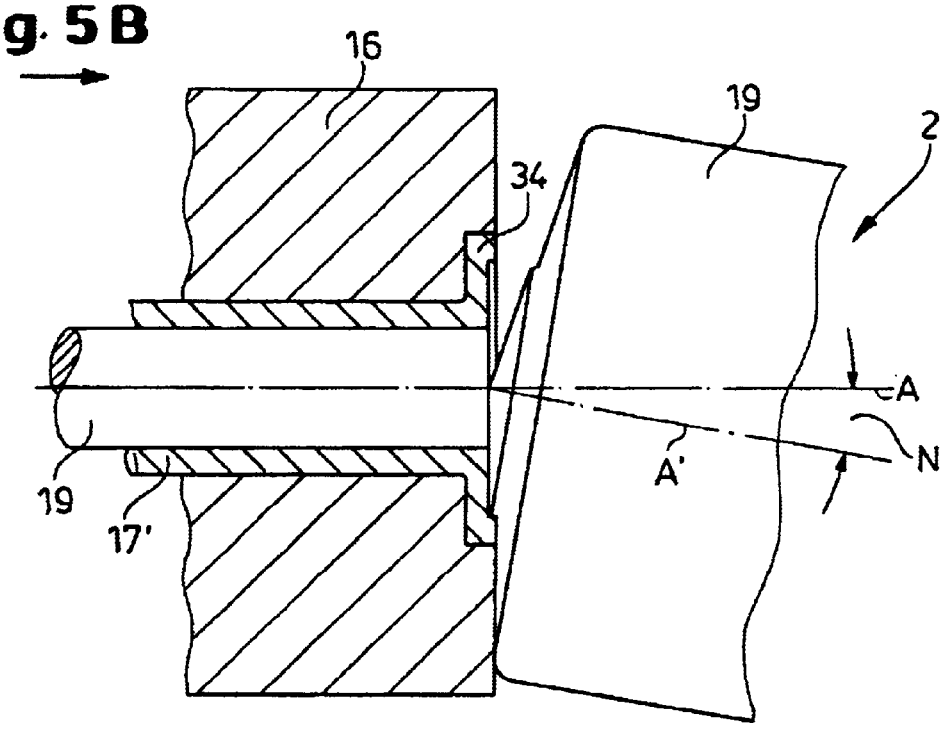

Subsequently as shown in FIGS. 5A and 5B the tube 24 and holder 16 are shifted axially outward to press the end of the workpiece 17 against the tip 19 of the tool 2 so as to deform it into the cavity 40 and form the flange 34. The rod 29 retracts inward against the force of the spring 30 as the tools 2 and 4 move together. FIG. 5B corresponds to FIG. 4A.

Figure 6A:
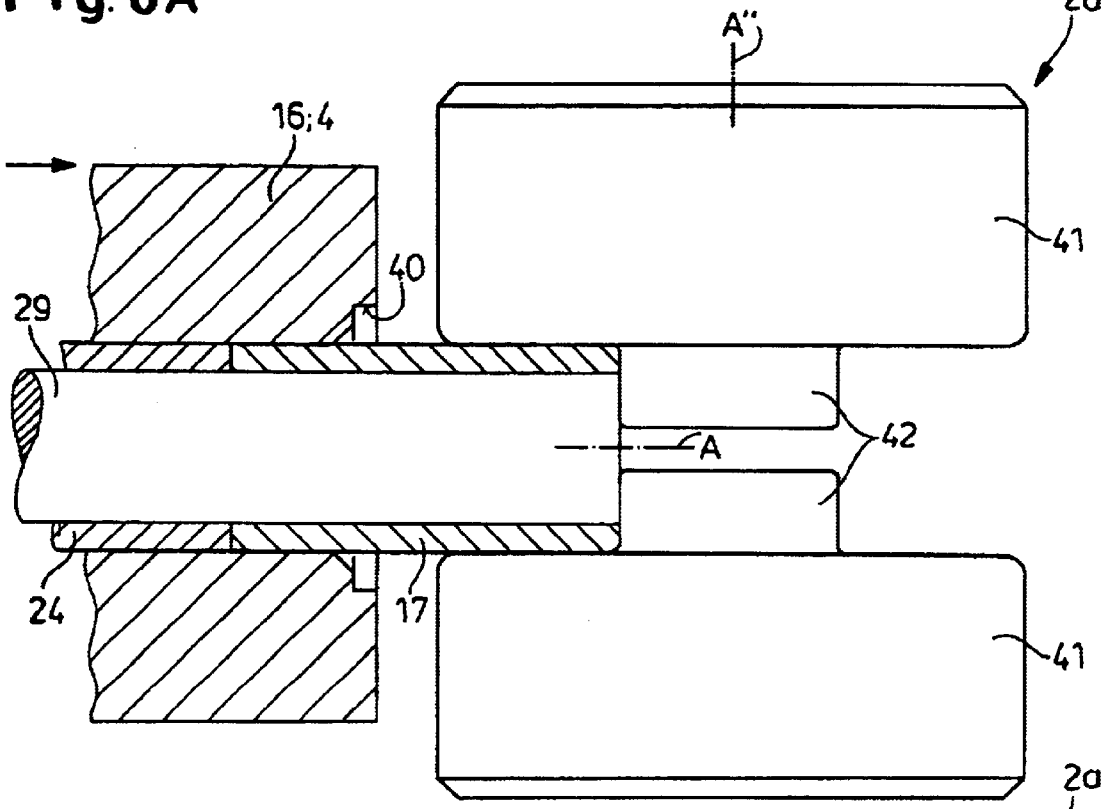
FIGS. 6A and 6B are views like FIGS. 5A and 5B but for a middle flange.
Figure 6B:
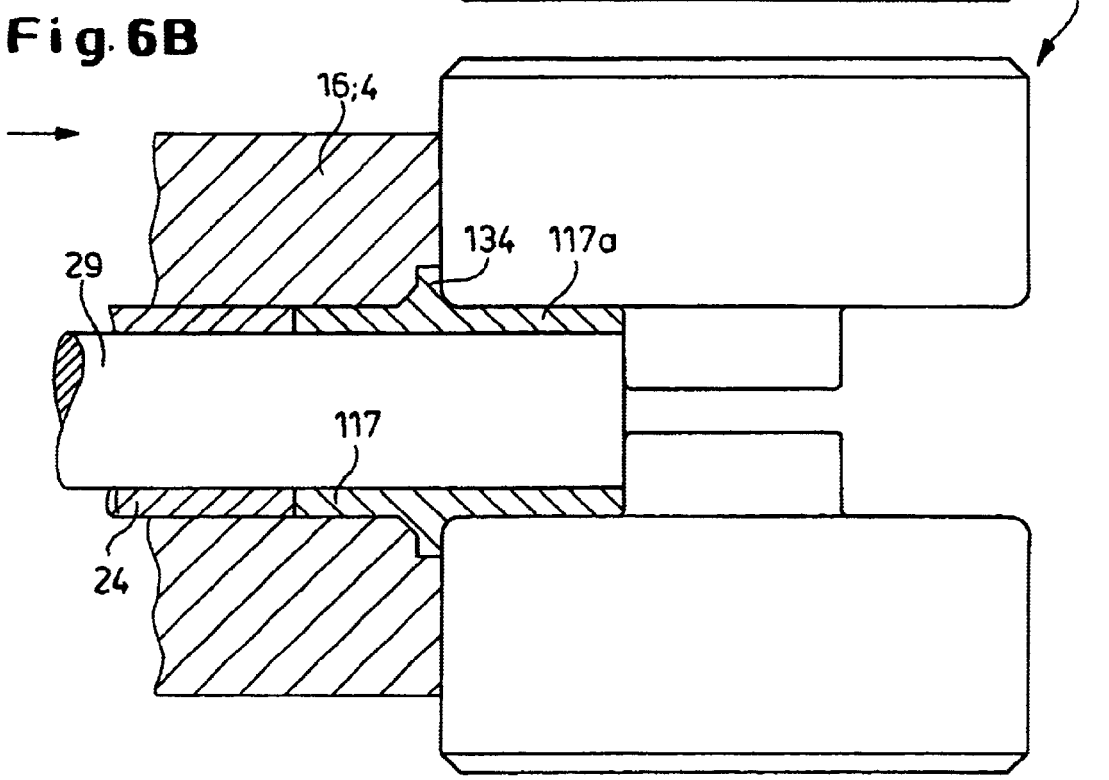

FIGS. 6A and 6B show how, instead of the tool 2, a tool 2*a* can be used comprised of two cylindrical rollers 41 rotatable about an axis A" perpendicular to the axis A and having short end stems 42. This tool 2*a* is rotated about the axis A as the holder 16 and tool 4 are pushed axially outward so that the end of the tube blank 17 presses against the stems 42 and then, on further outward movement, the workpiece 17 is upset to form an intermediate workpiece 117 having a middle flange 134. During such formation the mandrel 29 retracts so that the inner wall surface of an outer tubular part 117*a* of the intermediate workpiece 117 thus formed is cylindrical.

Figure 6C:
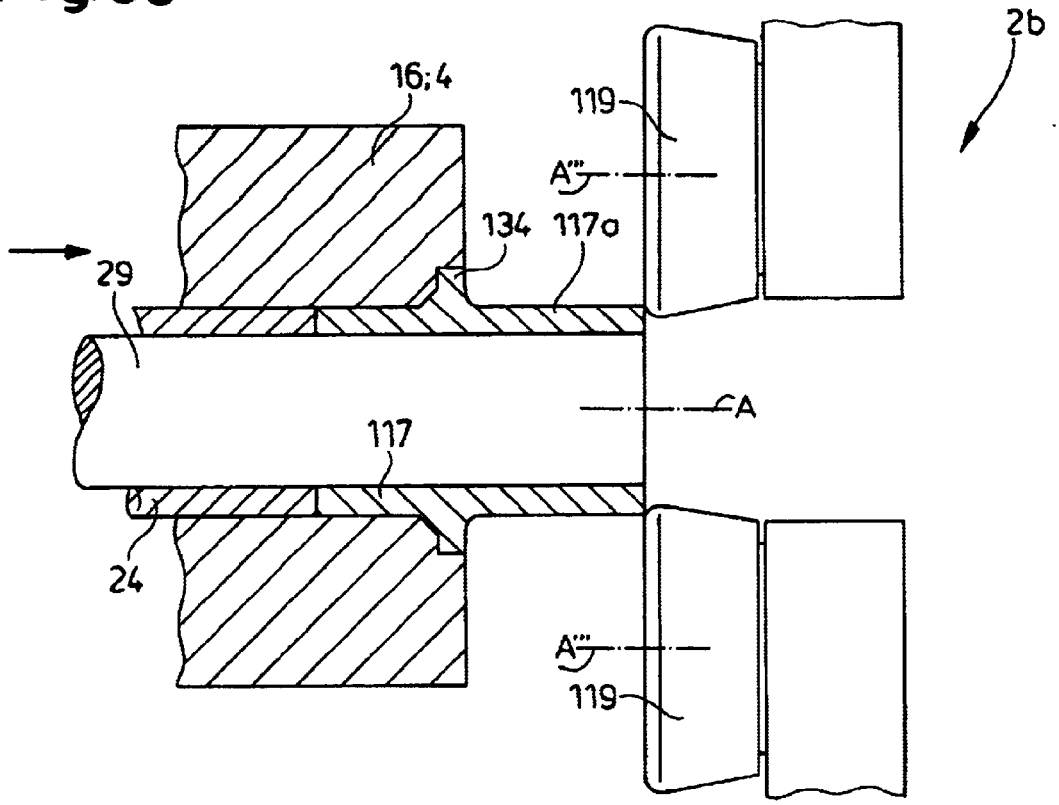
FIGS. 6C and 6D are views like FIGS. 5A and 5B showing a further formation step on the finished workpiece of FIG. 5B.
Figure 6D:
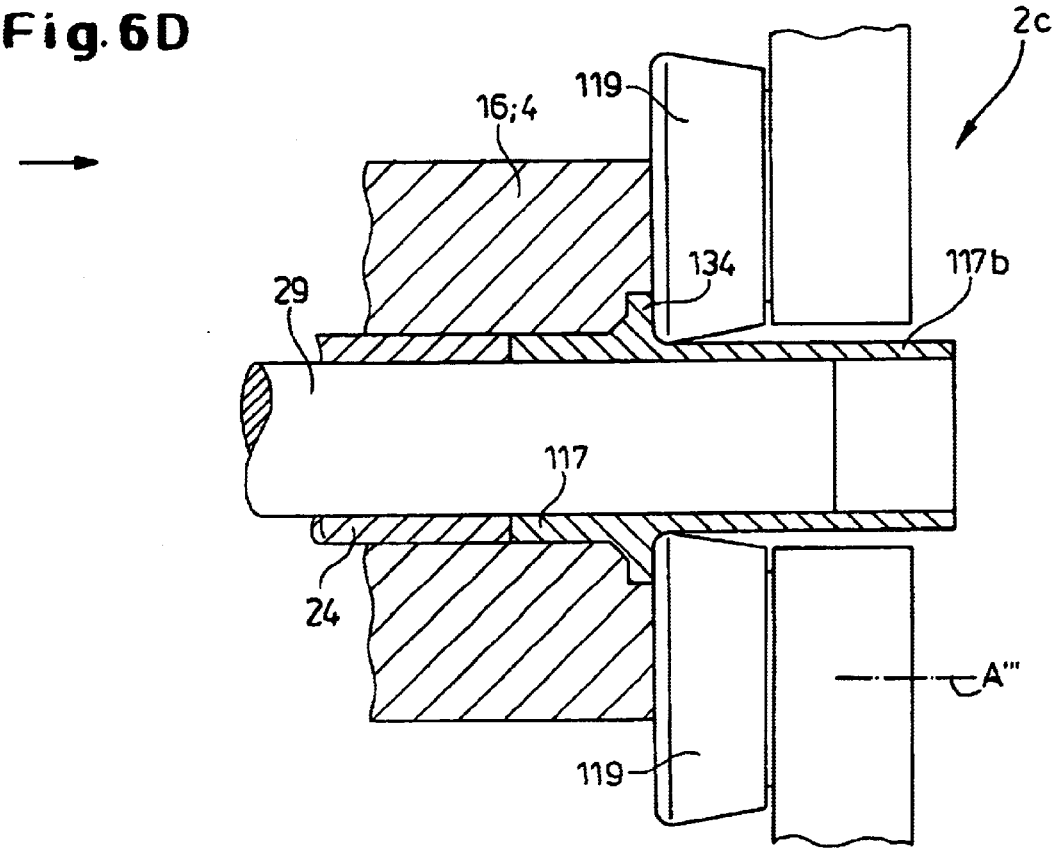
Figure 7:
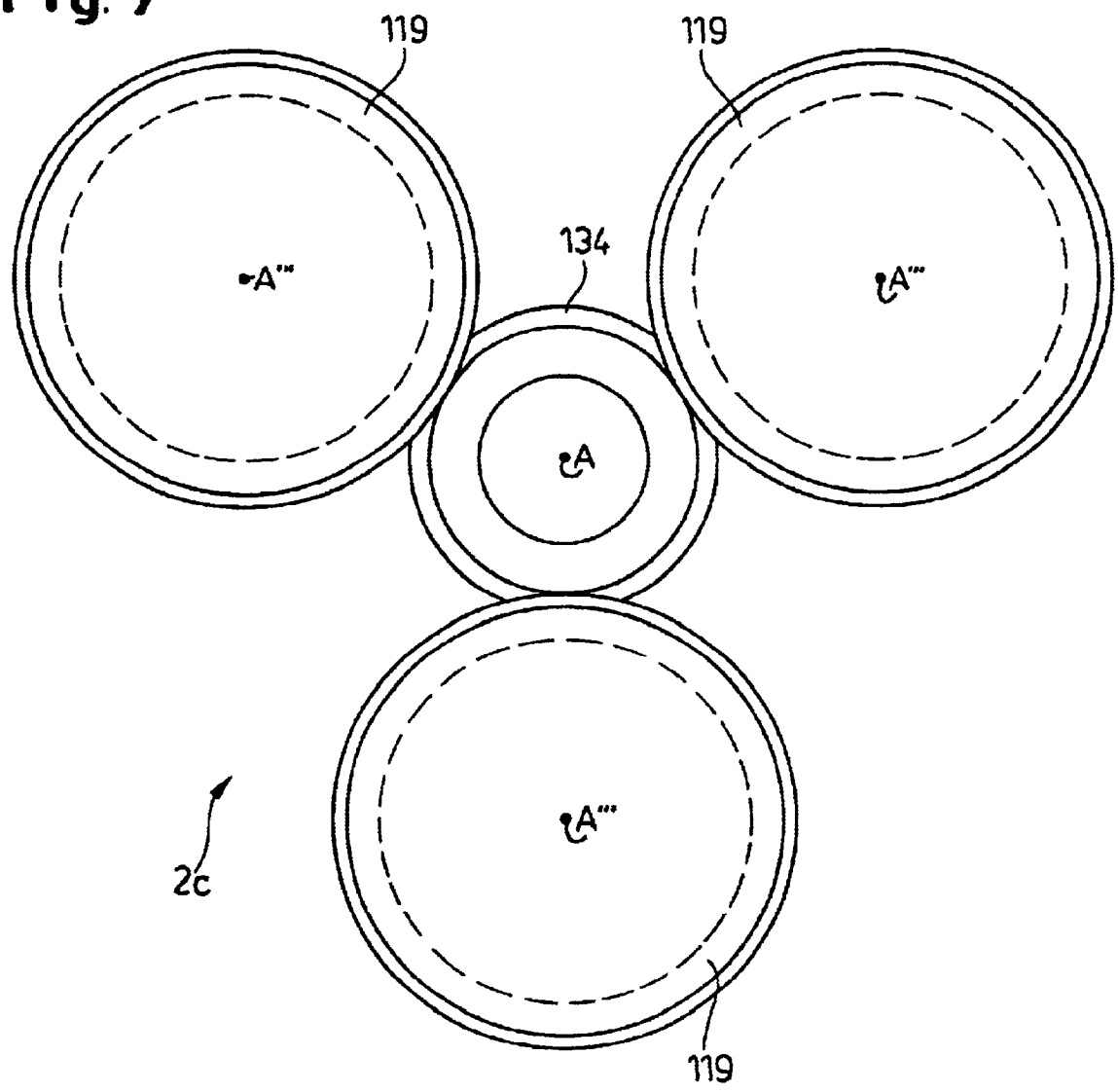
FIG. 7 is an end view of the apparatus shown in FIGS. 6C and 6D.

Then as shown in FIGS. 6C and 6D the intermediate workpiece 117 is pressed axially against another tool 2*c* having three rollers 119 (see also FIG. 7) rotatable about axes A'" parallel to the axis A. The tool 2*c* is rotated about the axis A to further push in the outer part 117*a*, thereby reducing its wall thickness and elongating it as shown at 117*b*. In this situation the mandrel 29 does not engage the tool 2*b* so it does not need to retract, causing the axial elongation of the workpiece 117.

In FIGS. 8A and 8B the rotatable but axially nonmoving tool 2*d* is formed by the roller 19 that first forms an intermediate flange 234*a* of the outer end of the solid workpiece 18. This flange 234*a* does not fill the cavity 40. Another roller tool 219 of an outer tool 2*d* formed with a central cavity is engaged over the outer end of the solid workpiece 18 so as to form on it a finished middle flange 234*b*, with a short stub end 43 that fits into the cavity of the tool head 219.

Figures 9A, 9B:
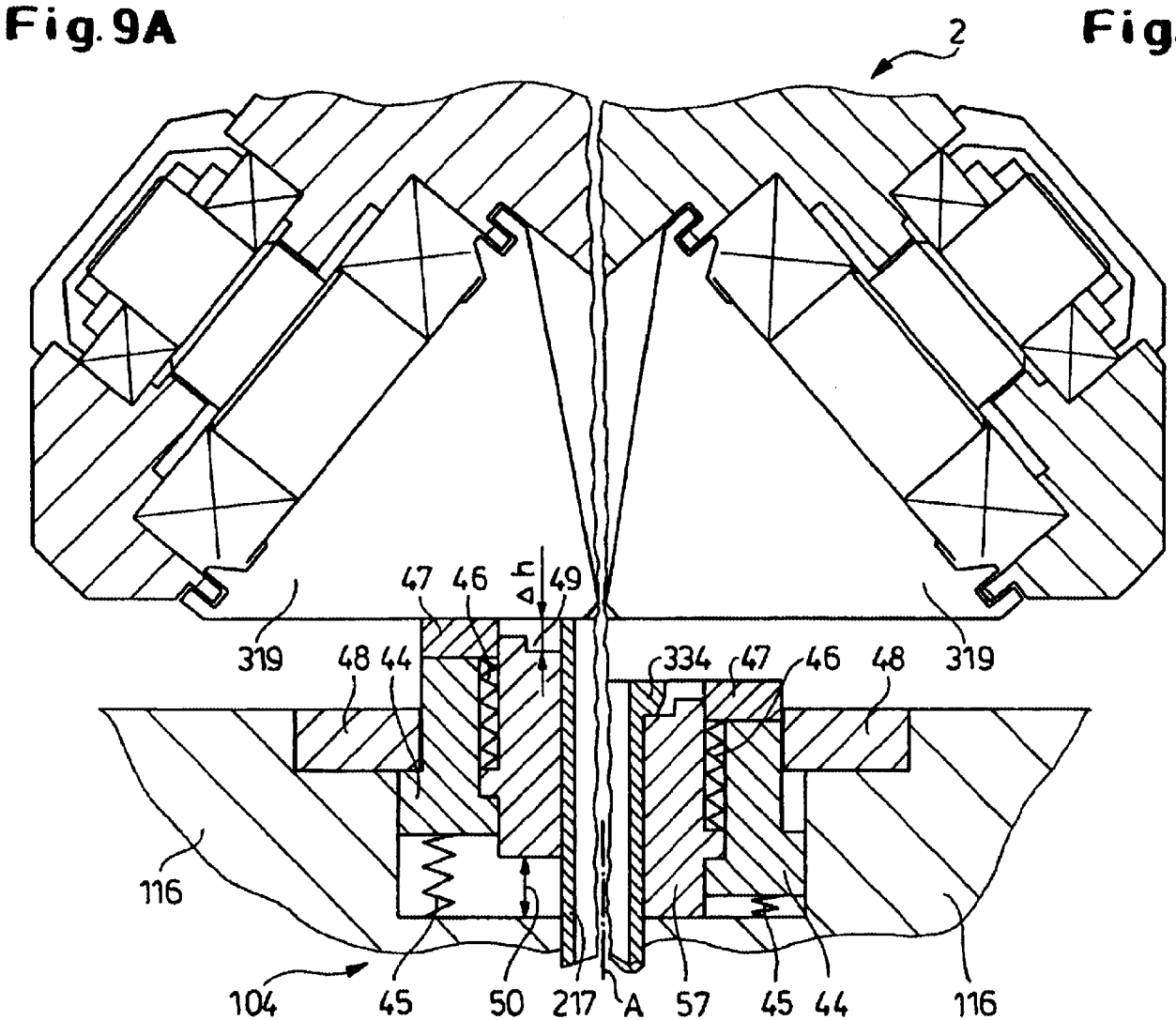
FIGS. 9A and 9B are axial sections through another end-flanging apparatus in accordance with the invention at two different stages in the cold-forming process.

The system of FIGS. 9A and 9B uses three conical roller tools 319 angularly equispaced about the axis A. Here an inner tool 104 in which a workpiece 217 is coaxially guided and from which it to start with projects by a distance Δh has an inner sleeve part 57 and a coaxial outer sleeve part 44. The part 57 is formed on its outer end with a recess 49 and is, to start with spaced a distance 50 from a base of a cavity in the holder 116 carrying the tool 104 and is biased axially inward by a spring 46. The outer sleeve part 44 is biased outward by a spring 45 into engagement with a retainer ring 48 fixed in the holder 116. The part 44 carries an end ring 47 against which the springs 46 are braced.

Thus as the inner tool 104 is moved axially outward, the tools 319 will first engage the end of the workpiece 217 and the outer face of the end ring 47 as shown in FIG. 9A. As they continue to move together first the outer sleeve 44 will be pushed inward because the spring 46 is stronger than the spring 45 and then, as a flange 334 is formed, the sleeve 57 will itself move inward until it bottoms in the holder 116. During this action, which requires a relatively low axial force, the workpiece 217 moves relative to the tool 104. With further movement together the outer sleeve part 44 and its ring 47 are pushed down into the holder 116 until the outer face of the ring 47 is flush with the outer face of the ring 48 and holder 116. During this movement, which requires a much higher axial force, there is no relative axial movement between the workpiece 217 and the tool 104, only radial outward movement of its deforming end and axial retraction of the mandrel rod 29 (not shown here for clarity of view). This will deform the intermediate flange 334 into a final-shape flange having the exact shape of the recess 49.

Figure 10:
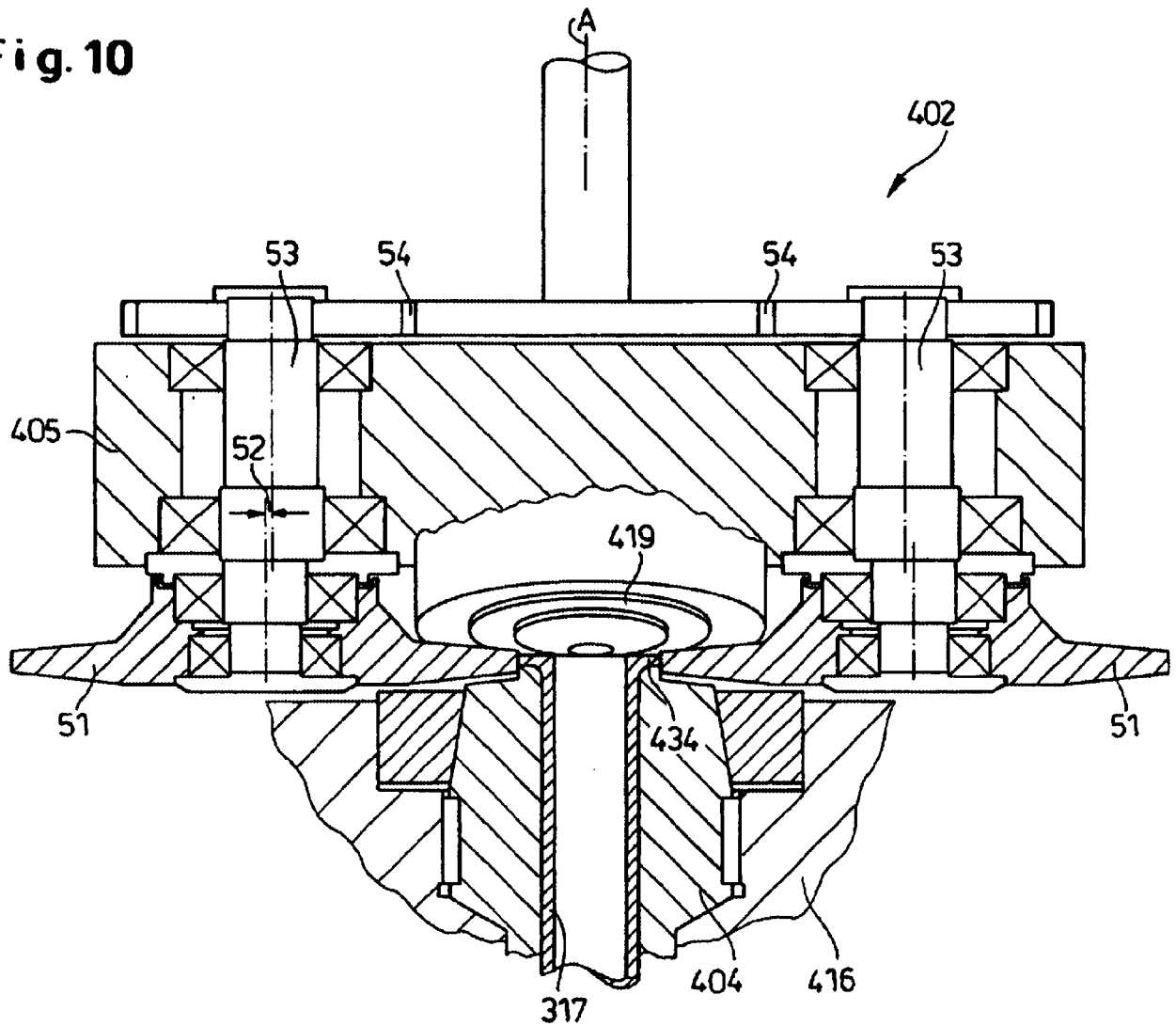
FIG. 10 is a section through another end-flanging system according to the invention.
Figure 11:
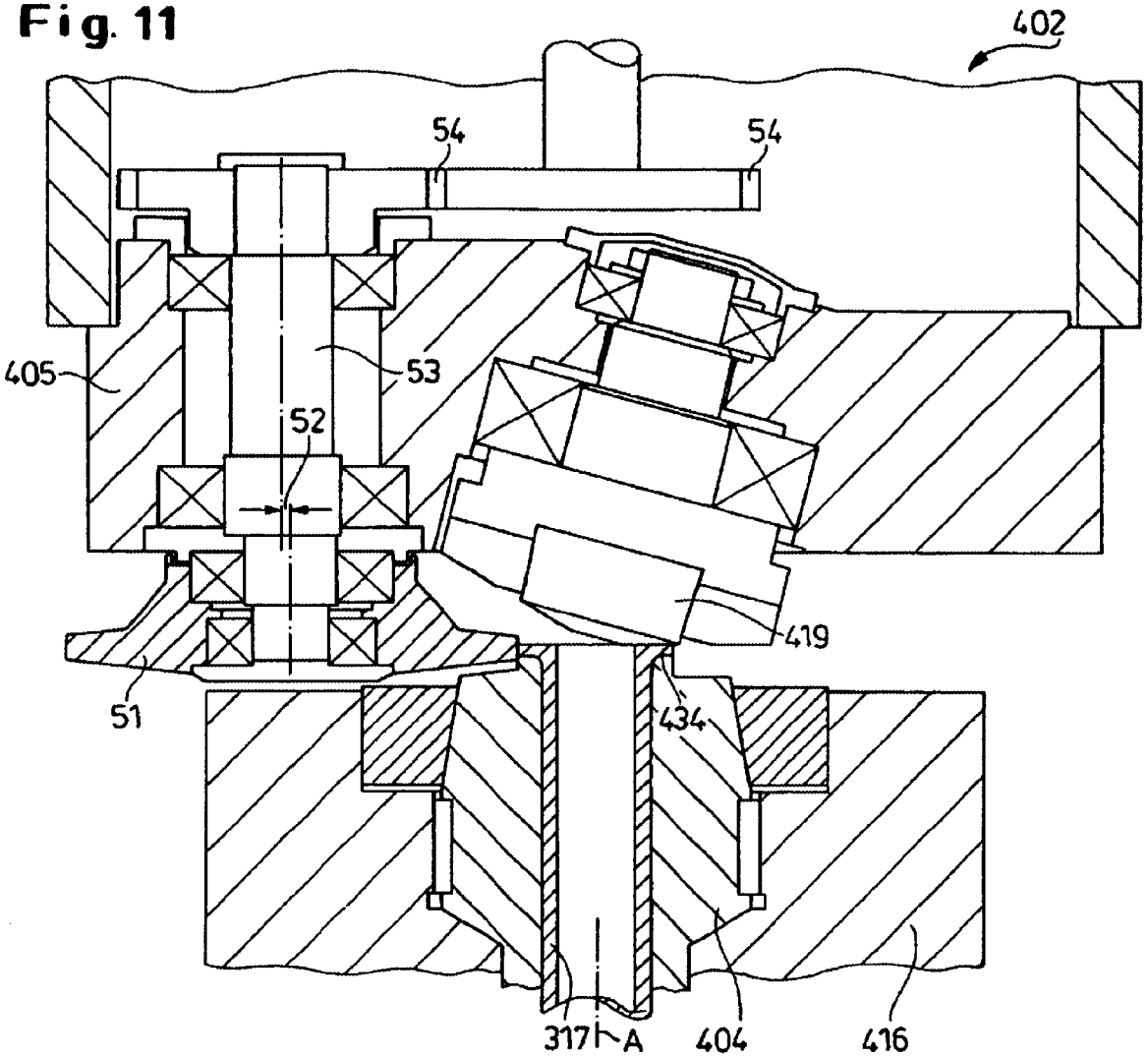
FIG. 11 is another sectional view of the FIG. 10 system.

FIGS. 10 and 11 show a system where the tool 402 has heads 419 angularly equispaced about the axis A of an inner tool 404 held in a holder 416 and engageable with an end of a workpiece 317 held in the axially displaceable tool 404. The outer tool 405 carries, in addition to the tool heads 419, two 90° offset shafts 53 rotatably driven by a central gear 54 and having inner ends that are offset from the shaft axes by a distance 52 and that carry four angularly equispaced rollers 51 that therefore orbit about the axis A and that simultaneously move radially inward and outward slightly as they orbit. This arrangement prevents the formation of rips or folds in the flange 434 by simultaneously axially and radially deforming it.

Figure 12:
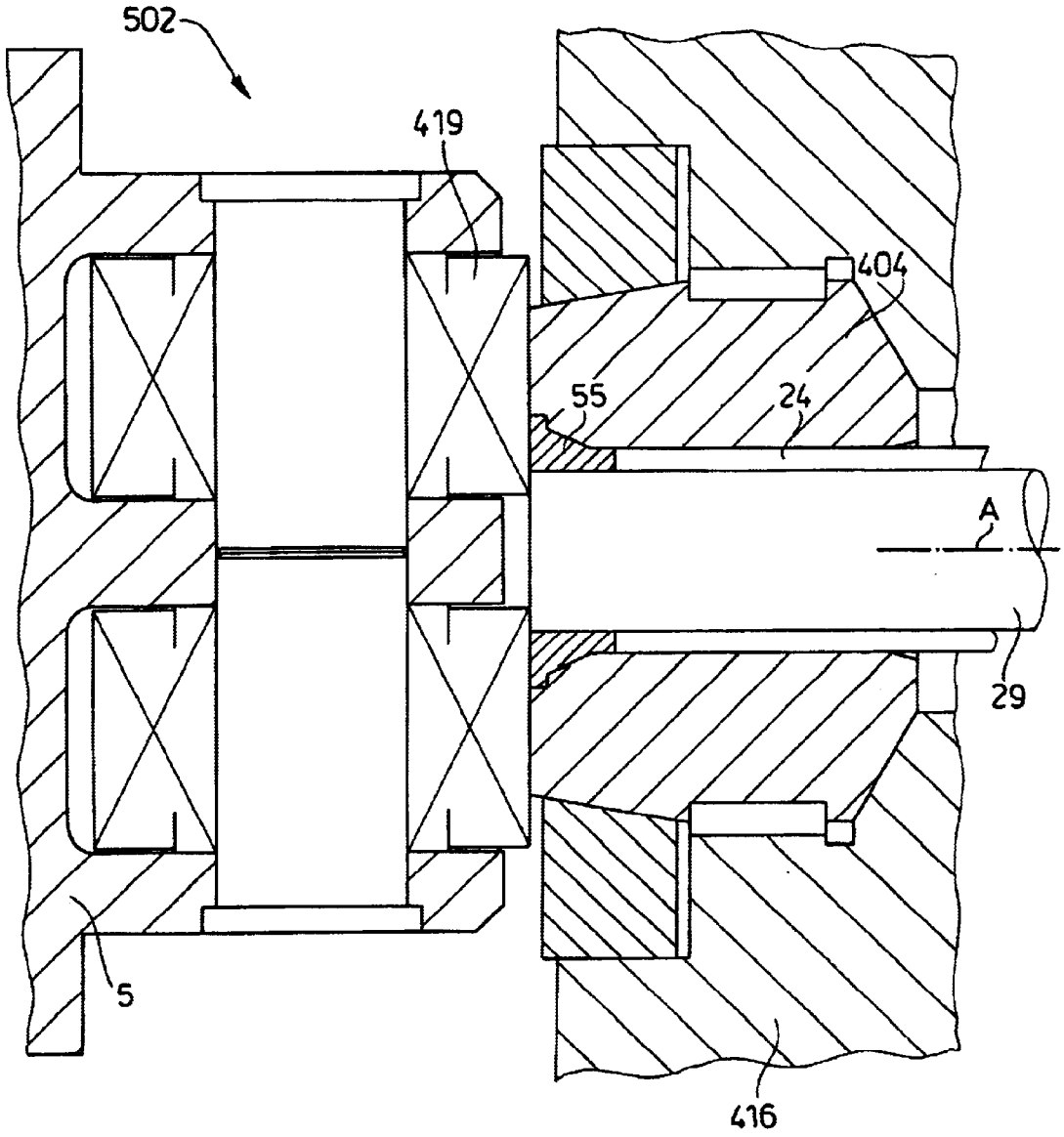
FIG. 12 is an axial section through yet another end-flanging system in accordance with the invention.

In FIG. 12 the outer tool 502 has a pair of rollers 419 rotatable about an axis perpendicular to the axis A. The rollers 419 have cylindrical outer surfaces flatly engageable with the planar out face of the tool part 404 to form a ring-like workpiece or flange 55 that is much shorter than any workpiece described above.

We claim:

1. An apparatus for forming a flange on a workpiece, the apparatus comprising:

a frame;

an inner holder shiftable on the frame along a main axis and adapted to hold the workpiece;

a roller rotatable about the main axis on the frame adjacent the inner holder;

a traverse axially displaceable on the frame;

a feed shaft fixed axially to the traverse and displaceable into and out of contact with an inner end of the workpiece in the inner holder;

means for pivoting the feed shaft between a position aligned with the main axis and a position offset from the main axis, whereby in the offset position a fresh workpiece can be fitted between the feed shaft and the inner holder;

actuator means braced between the traverse and the frame for axially displacing the feed shaft in its aligned position against an inner end of the workpiece in the inner holder; and means for displacing the inner holder and workpiece axially relative to the frame while securing the inner holder against rotation to press the workpiece axially against the roller, deform the workpiece, and form a flange on the workpiece.

2. The flange-forming apparatus defined in claim 1, further comprising a contactless measuring system connected to the inner holder.

3. The flange-forming apparatus defined in claim 1 wherein the means for displacing includes a pair of double-acting cylinders flanking the main axis and connected between the inner holder and the frame.

4. The flange-forming apparatus defined in claim 1, further comprising:

a shaft journaled in the frame for rotation about the main axis, connected to the means, and carrying the roller.

5. The flange-forming apparatus defined in claim 4 wherein the roller is rotatable on the shaft about a roller axis forming an angle of at least 10° with the main axis.

6. The flange-forming apparatus defined in claim 4, further comprising:

a counterweight on the shaft angularly equispaced about the main axis with the roller.

7. The flange-forming apparatus defined in claim 1 wherein the feed shaft is a tube shaft and the apparatus further comprises:

a mandrel slidable along the main axis in the tube shaft; and a spring braced against the mandrel and urging same axially toward the roller.

8. The flange-forming apparatus defined in claim 1 wherein the apparatus comprises an outer tool holder; and a plurality of the rollers carried on the outer tool holder and angularly equispaced about the main axis.

9. The flange-forming apparatus defined in claim 8, further comprising:

a plurality of secondary rollers carried on the outer tool holder and engageable radially inward of the main axis with the flange being formed on the workpiece.

* * * * *